US006908060B2

(12) United States Patent
Hibbs

(10) Patent No.: US 6,908,060 B2
(45) Date of Patent: Jun. 21, 2005

(54) RETAIL ELECTRICAL WIRE REEL CADDY

(76) Inventor: Patrick A. Hibbs, 2024 W. Cherry Tree Rd., Peoria, IL (US) 61615

( * ) Notice: Subject to any disclaimer, the term of this patent is extended or adjusted under 35 U.S.C. 154(b) by 73 days.

(21) Appl. No.: 10/649,949

(22) Filed: Aug. 28, 2003

(65) Prior Publication Data

US 2005/0045759 A1 Mar. 3, 2005

(51) Int. Cl.[7] ..... B65H 49/26; B65H 49/32; B65H 75/20; B65H 75/24

(52) U.S. Cl. ..... 242/578.2; 242/588.2; 242/604.1; 242/129; 242/597.4; 242/407.1

(58) Field of Search ..... 242/588, 588.2, 242/578.2, 604.1, 118.1, 406, 407.1, 403.1, 242/129, 129.7, 597.2, 597.4

(56) References Cited

U.S. PATENT DOCUMENTS

| | | | | |
|---|---|---|---|---|
| 2,489,108 A | * | 11/1949 | Schmidt | 242/604.1 |
| 3,072,357 A | | 1/1963 | Sprague et al. | |
| 3,432,113 A | | 3/1969 | Freedman | |
| 3,503,569 A | | 3/1970 | Gildart | |
| 3,544,031 A | * | 12/1970 | White | 242/407.1 |
| 3,880,378 A | * | 4/1975 | Ballenger | 242/406 |
| 6,027,066 A | * | 2/2000 | Street | 242/578.2 |
| 6,199,786 B1 | | 3/2001 | Lessard et al. | 242/406 |
| 2002/0038837 A1 | * | 4/2002 | Jackson | 242/588.2 |
| 2003/0085316 A1 | * | 5/2003 | Mostowy | 242/588.2 |

FOREIGN PATENT DOCUMENTS

DE 4005223 A1 * 8/1991 ..... 242/406

* cited by examiner

*Primary Examiner*—John M. Jillions
(74) *Attorney, Agent, or Firm*—Richard C. Litman

(57) ABSTRACT

A retail electrical wire reel caddy has a steel frame which may be rested upright, the upper portion of the caddy serving as a handle. The back has a slight angled configuration allowing easy grasp for lifting from prone to upright positions. The reel is of identical front and rear circular members, the outer member being turned to face the rear member so as to interlock "U"-shaped wire coil supports which are integral with supporting spokes extending between an outer rims and inner reel hubs. The caddy has a shaft extending forward from a mounting plate located on the back vertical portion of the frame, the frame having a forward extending base portion extending beneath the reel for stability.

18 Claims, 7 Drawing Sheets

RETAIL ELECTRICAL WIRE REEL CADDY

BACKGROUND OF THE INVENTION

1. Field of the Invention

The present invention relates to wire reel assemblies. More particularly, the present invention relates to a caddy having a wire reel for holding and distributing electrical wire from a wholesale supply coil.

2. Description of the Related Art

The use of insulated electrical wire is widespread and is available to construction contractors and hobbyists or homeowners at most hardware stores. The wire generally is obtained from a wholesaler or maker in standard sized coils which are wrapped and held in a coil configuration by ties for transport or handling. The retailer, such as the hardware store, must uncoil the wire to measure and sell desired lengths to a customer. Popular types of wire are generally provided in at least two widths of coil depending on the configuration and size of the electrical wire. These coils generally have the same inner diameter, but the cross section of the coil may vary, depending on the size of wire. The cross section of coils is generally one of two sizes for retail distribution. It would be desirable to provide a caddy supporting a reel which is adjustable to easily receive either size of electrical wire coils as received from a supplier and to support the wire coil for even, flat, and straight distribution of wire in a length as sold to a retail customer. It would also be desirable to provide such a caddy which is easily moved between locations along with the reel of wire supported for rotation thereon. Such a caddy and wire reel may then be easily moved to and between building sites if desired or between storage room and retail space.

U.S. Pat. No. 6,199,786 B1, issued Mar. 13, 2001, to Lessard et al., describes a wire reel assembly having a reel, a reel support, and a reel securing assembly. The reel includes a central body and removable sides. The central body is removably mounted to an arm of the reel support allowing one of the removable sides to be disconnected from the central body without requiring disassembly of the reel support.

U.S. Pat. No. 3,072,357, issued Jan. 8, 1963, to Sprague et al., describes a portable reel carrier, which includes a plurality of identical reel portions, pairs of which interlock to form wire cable supports when placed in opposed positions on a support shaft.

U.S. Pat. No. 3,503,569, issued Mar. 31, 1970, to Gildart, describes a collapsible reel that includes wire frame end flanges which may be manually removed from the reel to permit uncoiling.

U.S. Pat. No. 3,432,113, issued Mar. 11, 1968, to Freedman, describes a split reel having a central hub of two interfitting parts attached to end flanges.

None of the above inventions and patents, taken either singly or in combination, is seen to describe the instant invention as claimed. Thus, a retail electrical wire holder solving the aforementioned problems is desired.

SUMMARY OF THE INVENTION

The inventive retail electrical wire reel caddy has a steel frame which may be rested upright, the upper portion of the caddy serving as a handle. The caddy may also be rested in a prone position on its back for hauling, such as in a truck bed, the back having a slight angled configuration allowing the user to easily grasp the caddy frame for lifting it to the upright position. The reel is made up of identical front and rear circular members, the outer member being turned to face the rear member so as to interlock "U"-shaped wire coil supports which are integral with supporting spokes extending between an outer rims and inner reel hubs. The caddy has a shaft extending forward from a mounting plate located on the back vertical portion of the frame, the frame having a base portion extending forward beneath the shaft and supported reel so as to stand securely when a coil of wire is supported on the reel and the wire is distributed from the reel for sale.

Accordingly, it is a principal object of the invention to provide an electrical wire reel and caddy for retail dispensing of wire.

It is another object of the invention to provide a wire reel and caddy which is adjustable for different sized coils of wire.

It is a further object of the invention to provide a wire reel and caddy as above which is adjustable to compensate as the wire is drawn down.

Still another object of the invention is to provide a wire reel and caddy as above which is easily moved between locations.

Yet another object of the invention is to provide a wire reel and caddy as above which may be stored upright or level on its back.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is retail electrical wire reel caddy having a steel frame which may be rested upright, the upper portion of the caddy serving as a handle. The caddy may also be rested in a prone position on its back for hauling and has a shaft extending from the frame back for mounting a reel. The reel is made up of identical front and rear circular members, the outer member being turned to face the rear member so as to interlock "U"-shaped wire coil supports which are integral with supporting spokes extending between an outer rims and inner reel hubs. The reel is adjustable to hold different width wire coils. The frame has a base extending forward beneath the shaft and the reel mounted thereon so as to stand securely when a coil of wire is supported on the reel and the wire is distributed from the reel for sale.

Figure 1:
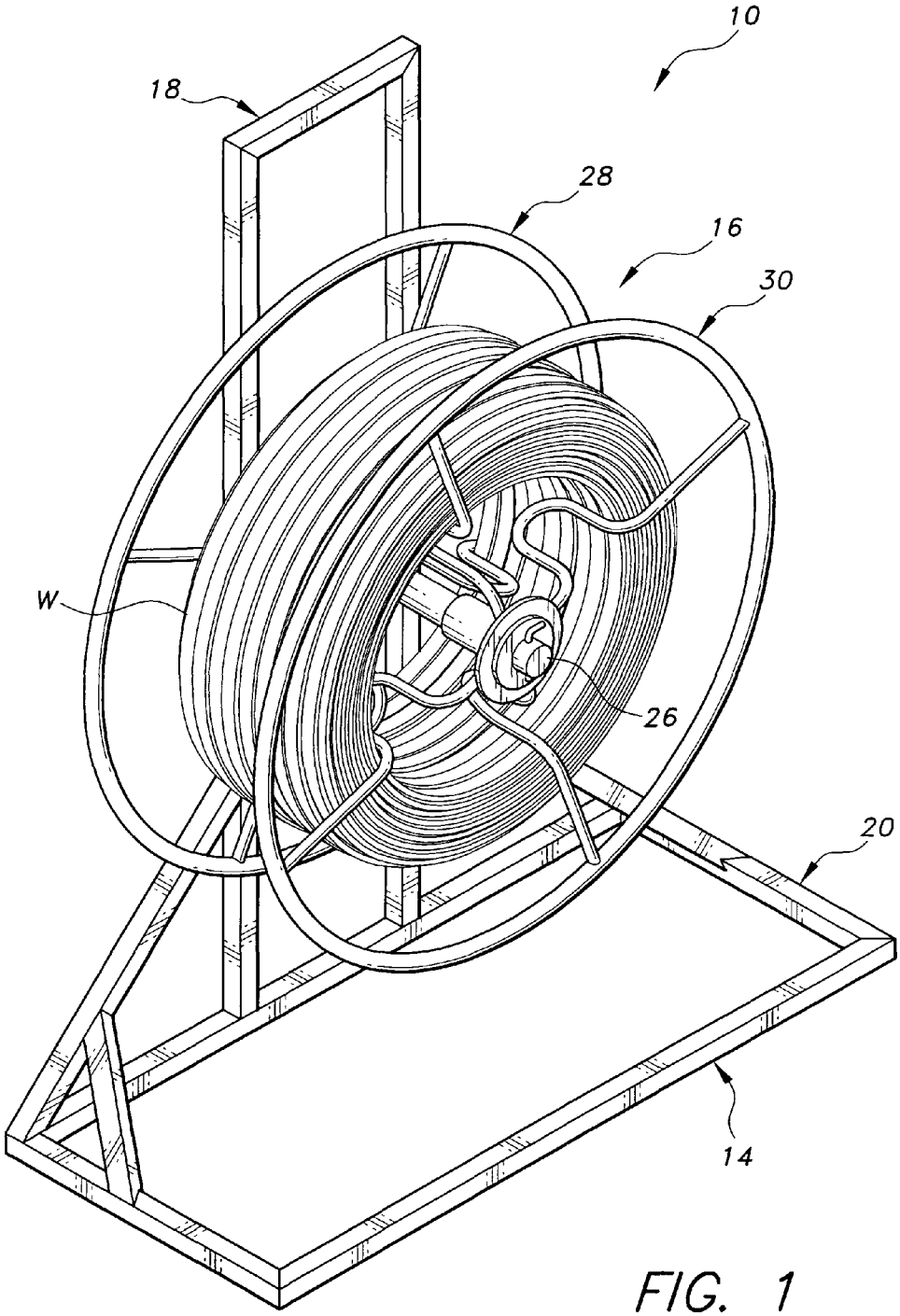
FIG. 1 is an environmental, perspective view of the electrical wire reel caddy of the present invention with a large wire coil installed.

Referring to the FIG. 1, there is shown an adjustable electrical wire coil retail wire dispensing caddy referred to be the reference number 10 having a support frame 14 and a reel 16 for holding and dispensing electrical wire W. Frame 14 has an upright portion 18 and a base 20.

Referring to FIGS. 2–7, the upright portion 18 of support frame 14 has two spaced uprights 22 extending upward from base 14 connected at their upper end by upper cross member 24 which may serve as a handle for moving the caddy 10. Reel support shaft 26 extends forward from frame upright portion 18 centrally over frame base 20 and supports the inner reel portion 28 and the outer reel portion 30 for rotation in a plane parallel to frame upright portion 22. As shown, inner reel portion 28 and outer reel portion 30 are structurally identical, the outer reel portion being turned toward the rear and partially rotated to interfit and provide support for electrical wire coil W.

Reel portions 28 and 30 each have a centrally mounted, cylindrical reel hub of such inner diameter so as to slidingly fit over shaft 26 and rotate thereon. Reel hub 32 has a free end and is attached to a circular plate 34 opposite the free end. A reel rim 36 is circumferentially attached to reel hub 32 by four, equally spaced, spokes 38 affixed as by welding to hub circular plate 34. Reel spokes 38 each form a "U"-shaped coil support 40 spaced therealong and extending axially in concert with reel hub 32, each "U"-shaped coil support forming an outer radius bend 42 formed to fit the cross-section of wire coil W.

During the mounting and assembly of reel 16, inner reel portion 28 is mounted on caddy reel support shaft 26 with reel hub 32 and "U"-shaped coil supports 40 extending outward. Then outer reel portion 30 is mounted with reel hub 32 and "U"-shaped coil supports 40 extending inward such that they interfit between those of the inner reel coil supports so as to collectively form an inner coil support reel hub of a diameter equal to that of the electrical wire coil inner diameter. Washer 44 is located between circular plate 34 and pin 46 is placed in one of cross bores 48 in the end portion of shaft 26 (see FIG. 7) to secure the wire-loaded reel 16 for dispensing wire as desired.

Figure 4:
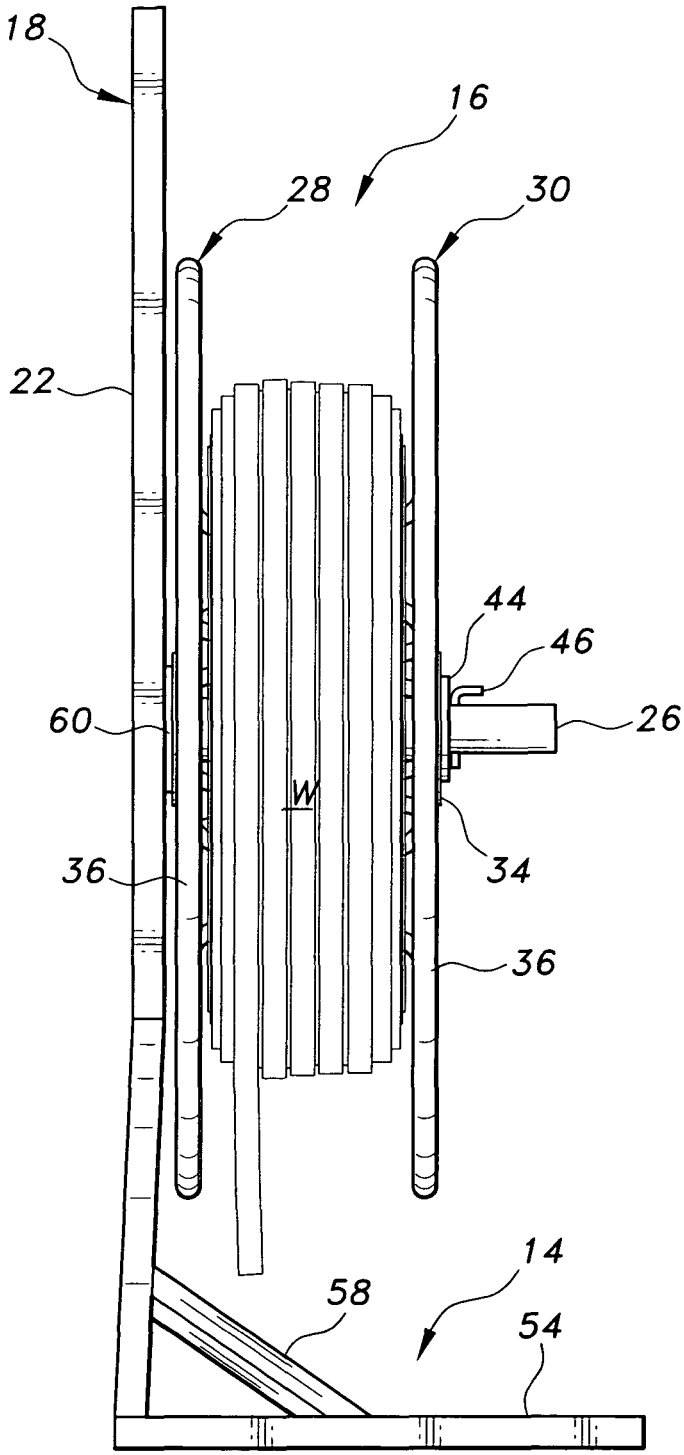
FIG. 4 is a side elevation view of the inventive caddy and reel with a small wire coil installed.
Figure 5:
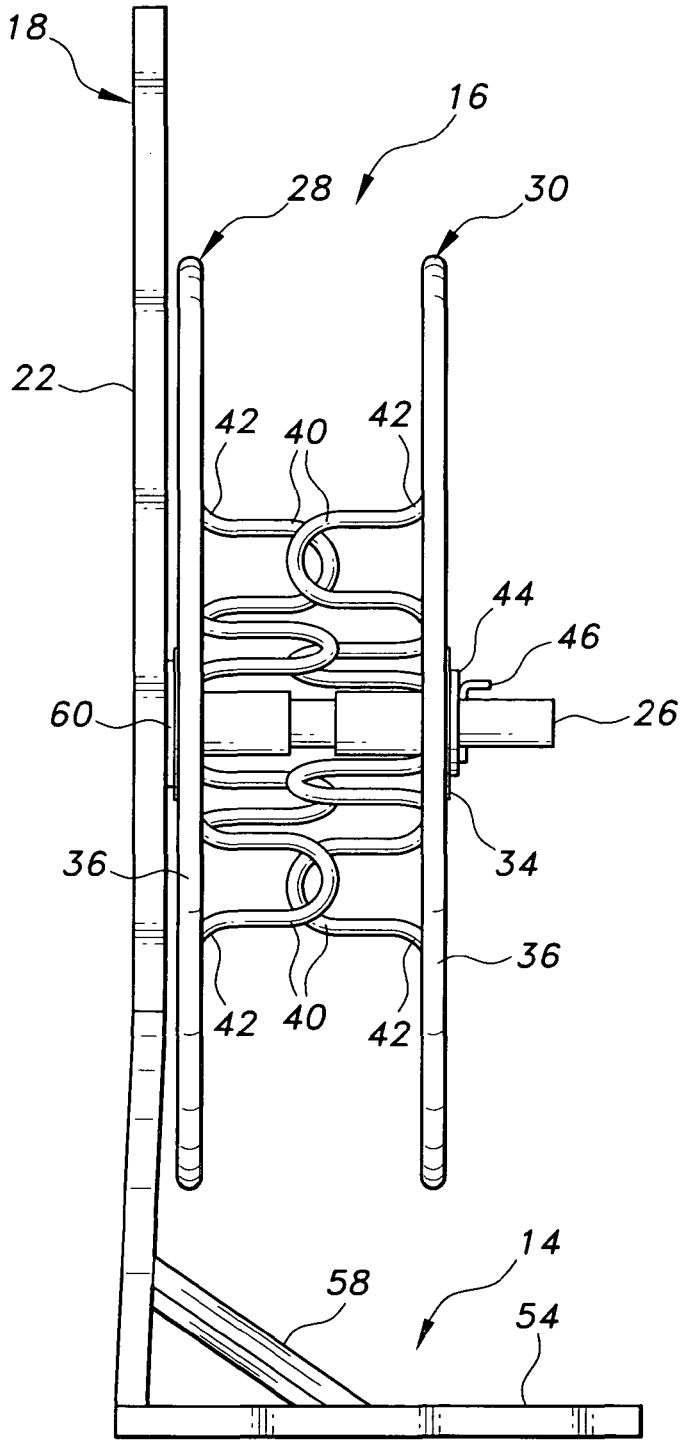
FIG. 5 is a side elevation view as in FIG. 4 showing the coil supports without the wire coil.
Figure 6:
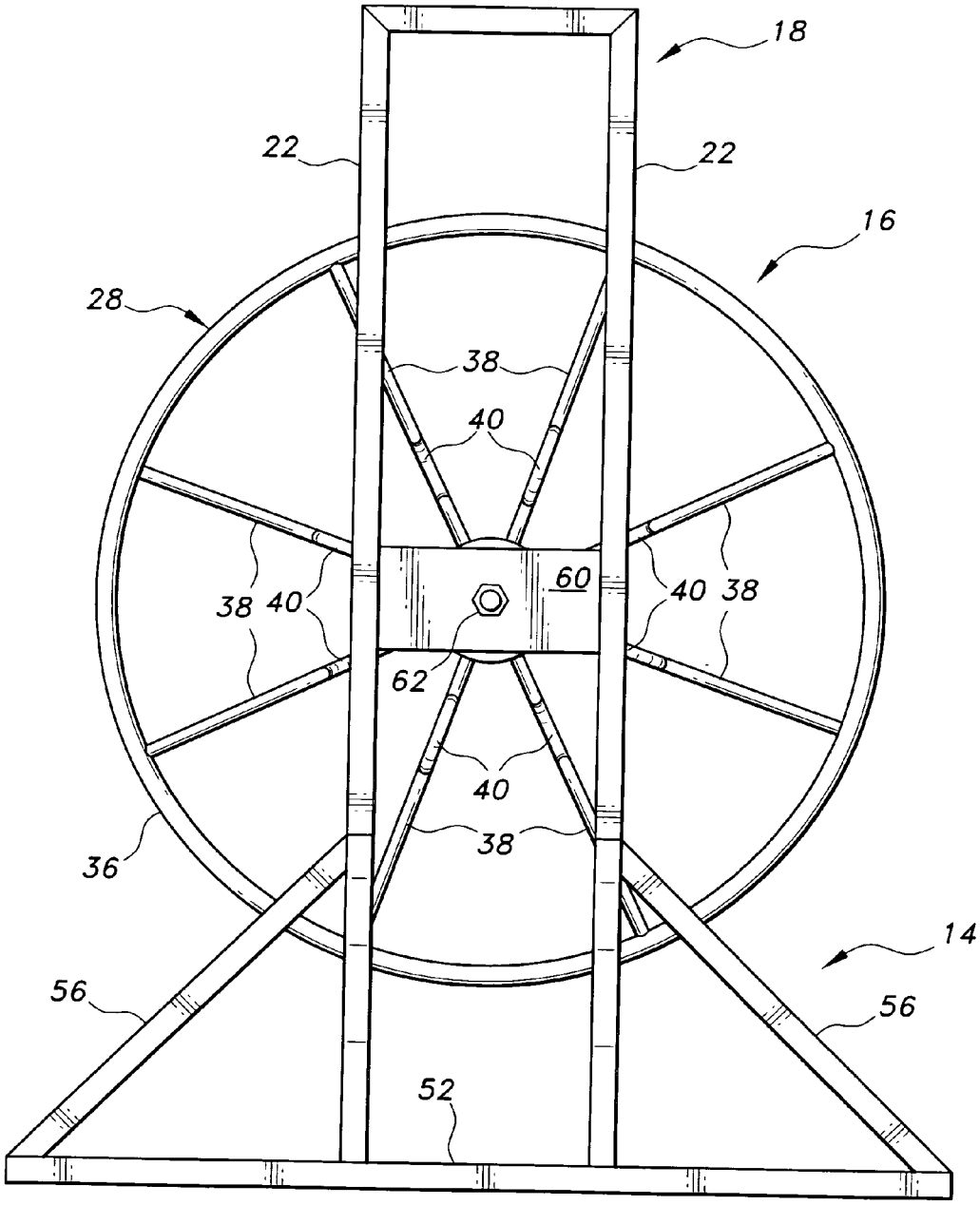
FIG. 6 is a rear elevation view of the inventive caddy and reel with the wire coil.
Figure 7:
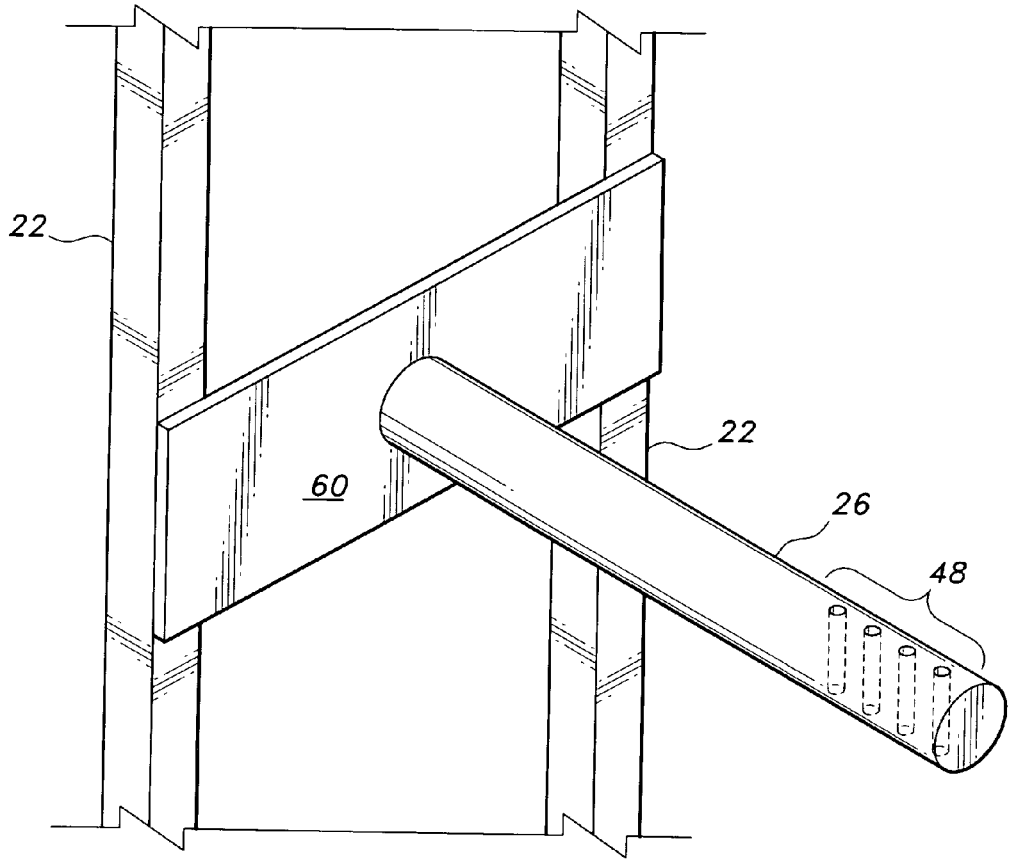
FIG. 7 is a detail view of the shaft with spaced cross bores of the caddy of FIG. 2.

As seen in FIGS. 4 and 5, a smaller coil of wire W is mounted for dispensing. In this case, outer reel portion 30 and washer 44 is moved inward to fit the smaller coil and pin 46 inserted into an inner cross bore 48. The cross bores 48 are preferably axially spaced at ¼ inch intervals from the free end of shaft 26 and provide for axial adjustment of the effective width of the reel 16 to accept different widths of wire coil and to provide adjustment as a wire coil becomes reduced in sized due to the periodic removal of wire as it is removed and sold. It may be desirable to adjust the outer reel inward to better support the remaining wire after the substantial removal of the coil reel. As illustrated in FIG. 6, the alternating "U"-shaped coil supports 40 of inner reel portion 28 and outer reel portion 30 must extend for a length so as to overlap to form a hub for supporting the wire coil supported thereon.

Figure 2:
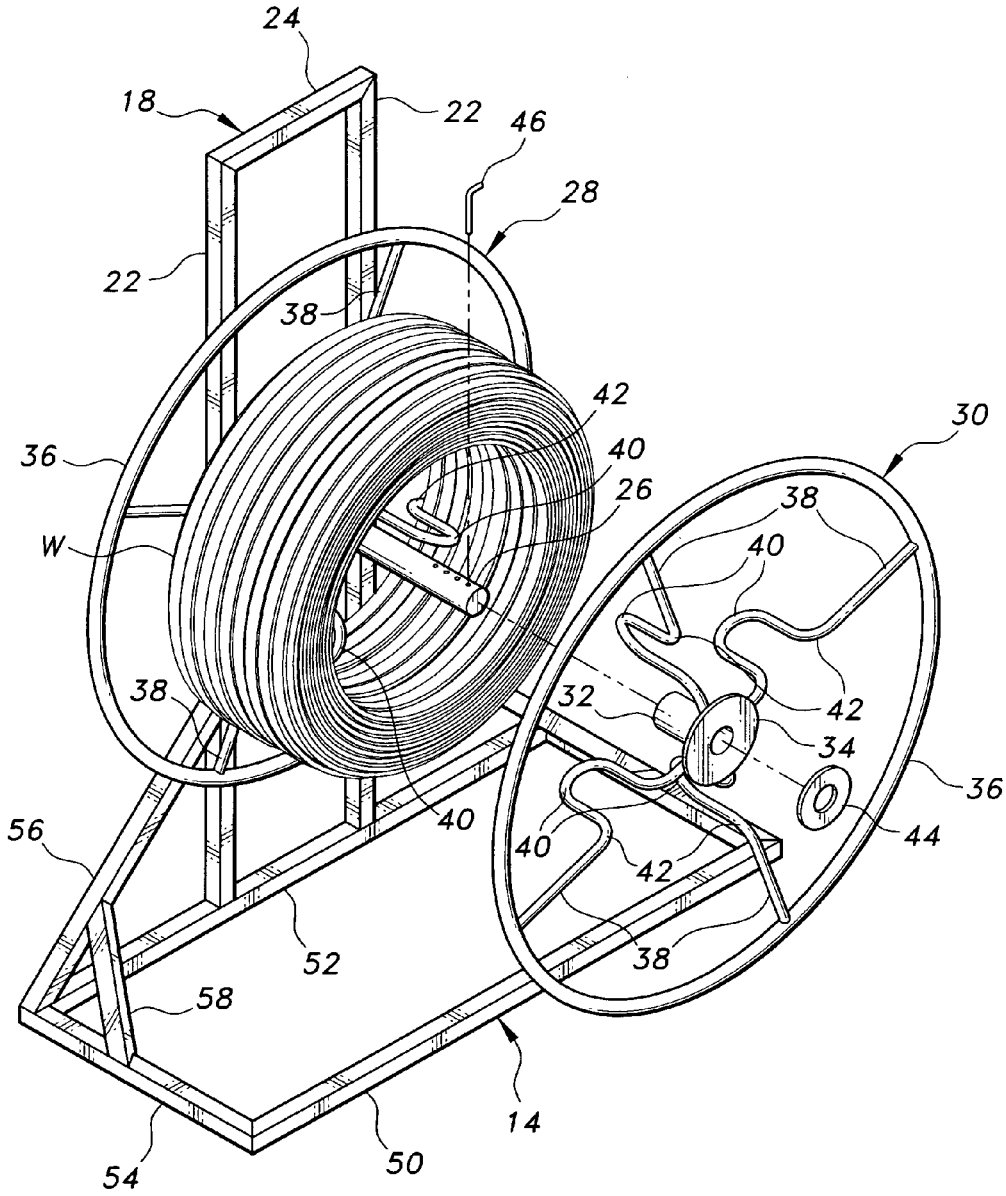
FIG. 2 is a view as in FIG. 1 with the outer reel portion, washer, and lock pin exploded away.
Figure 3:
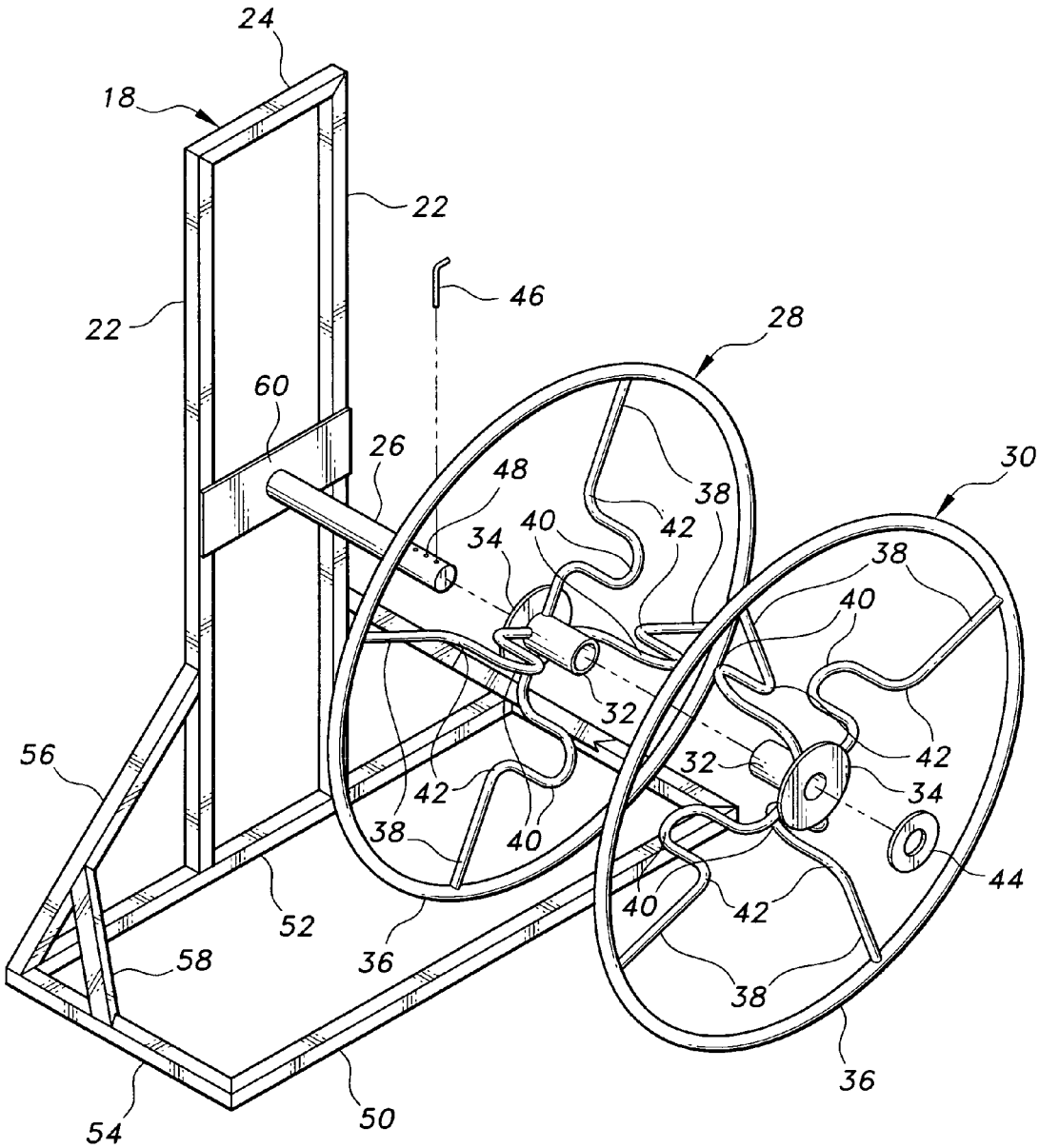
FIG. 3 is a view as in FIG. 2 with the inner reel portion exploded away and without wire coil.

Referring to FIGS. 2, 5, and 6, the caddy base 14 is rectangular and has a front member 50, a rear member 52 and opposed side members 54 and centrally supports spaced uprights 22 of upright portion 18. The lower portion of each upright member 22 has a lateral angle brace 56 extending between the upright member 22 and end of the respective adjacent end of the rear cross member 52. A forward brace 58 extends between the lateral angle brace and the respective adjacent base side member 12. This bracing provides for a rugged caddy frame, allowing the caddy to carry a heavy coil of electrical wire and to be moved between locations with the electrical wire coil in place without damage to the caddy. As seen in FIG. 5, the lower portions uprights 22 are angled forward from vertical between the rear base member ends and the attachment points of the respective angle braces so as to provide clearance at that point from the floor when the caddy is rested on its upright portion 18 on the floor such as during storage or transport to allow easy grasping of the uprights 22 for setting the caddy upright on base 20.

A shaft mount plate 60 is mounted as by welding between uprights 22 at a location about half the height of the upright portion 18. Shaft mount plate 60 receives the inner end of centrally located reel support shaft 26 through a centrally located throughbore and shaft 22 attached as by welding at rear shaft mount 62 to the rear of mount plate 60 so as to provide a rugged mounting therefor. The mount plate 60 also acts as a stiffener for caddy upright portion 18.

When the inventive caddy is loaded with an electrical wire coil and the washer and pin in place, the caddy is ready to dispense electrical wire from the free end (see FIG. 4). As the electrical wire W is pulled from the reel 16, the reel rotates with the reel hub circular plate of inner reel portion 28 turning against the inner surface of shaft mount plate 60, and the circular plate outer reel portion 30 turns against stationary washer 44. Since the inner portion 28 and outer portion 30 of reel 16, are not mechanically connected, the play in the coil and its mounting arrangement allows the reel hub 32 to adjust along shaft 26 so as to allow turning relative to the mount plate 60 when pulling force is applied on wire W while dispensing while friction with the reel hub circular plates minimizes turning of the reel 16 at other times, such as during moving or transport.

The various parts of the inventive caddy and reel are preferably steel to provide sturdiness and ease in welding and assembly. The wire dispensing caddy is 23 inches in overall height, each outer rim is 15 inches in diameter, the caddy upright portion is 5¼ inches in width and said reel support shaft is about ¾ inch in diameter. The wire dispensing caddy front and rear cross members of the base are 18 inches in length and the opposing side members are 8 inches in length.

The inventive caddy holds any size electrical wire supplied in predetermined length coils. A commonly supplied length of coil is 250 feet. Other benefits of the inventive caddy are that the wire unwinds from the caddy flat and straight, which makes it easier to pull into the walls or along a floor joist, eliminating the need to be straightened for use.

It is to be understood that the present invention is not limited to the embodiment described above, but encompasses any and all embodiments within the scope of the following claims.

I claim:

1. An adjustable retail electrical wire dispensing reel caddy, comprising:

a caddy frame having a rear upright portion and a forward extending base;

a horizontally disposed reel support shaft mounted on said caddy frame rear upright portion and extending forward over said forward extending base, a reel removably supported for rotation on said reel support shaft, said reel having inner and outer reel portions, each said reel portion comprising:

a cylindrical hub;

a circular outer rim;

said reel support shaft being spaced from said frame base by at least the radius of said reel outer rims;

a plurality of reel spokes extending radially between said cylindrical hub and said outer rim of said inner reel portion, each said reel spoke having a generally "U"-shaped coil support bend extending axially forward relative to said cylindrical hub and said circular outer rim, said coil support bend having an outer radius bend for supporting the wire coil;

said outer reel portion being axially adjustable along said reel support shaft;

said outer reel portion and said inner reel portion being mounted on said reel support shaft such that said "U"-shaped coil support bends circumferentially overlap so as to form an axle for supporting the wire coil for rotation;

said outer radius bends of said spokes conforming with the cross-sectional circumference of said wire coil; and removable means for adjustably retaining said outer reel portion of said reel along the outer portion of the length of said reel support shaft;

whereby said outer reel portion is removed from said axial support, a coil of wire is placed radially over the coil support bends of said spokes of said inner reel portion, said outer reel portion is placed on said reel support shaft such the coil support bends of the outer reel portion intersect and are circumferentially spaced from the inner reel portion coil support bends and are snug against the coil of wire, and said means for retaining the outer reel portion is mounted on said reel support shaft at a point such as to maintain the outer reel portion snug against the wire coil such that the wire in the coil may be distributed from the caddy in an even, flat and straight configuration, the reel rotating on the reel support shaft as the wire is pulled away from the coil to the length desired by the customer.

2. The wire dispensing caddy of claim 1, wherein each said reel portion further comprises a circular plate mounted on said reel hub, and said reel spokes are attached to and radially spaced around said circular plate.

3. The wire dispensing caddy of claim 2, wherein said upright portion of said caddy frame has two spaced vertical uprights, an upper cross member extending between upper ends of said vertical uprights, said upper cross member serving as a handle for tilting and moving said caddy.

4. The wire dispensing caddy of claim 3, wherein said upright portion of said caddy frame has a shaft mount plate extending between said uprights at the center portions thereof.

5. The wire dispensing caddy of claim 4, wherein said reel support shaft is attached at the center of said shaft mount plate and extends forward therefrom over said base.

6. The wire dispensing caddy of claim 5, wherein said circular plate of said inner reel portion turns against said shaft mount plate.

7. The wire dispensing caddy of claim 2, said outer portion of said reel support shaft contains a plurality of cross-bores spaced axially along said shaft outer portion and said means for adjustably retaining said outer reel portion of said reel comprises a pin for insertion in any of said spaced cross-bores.

8. The wire dispensing caddy of claim 7, further comprising a washer removably mounted on said reel support shaft between said pin and said outer reel portion and wherein said circular plate of said outer reel portion turns against said washer.

9. The wire dispensing caddy of claim 8, wherein said outer reel portion is adjustable relative to said inner reel portion so as to hold at least two sizes of wire coil.

10. The wire dispensing caddy of claim 3, wherein said caddy base has opposing front and rear cross members connected at each end thereof by opposing side members, said upright frame portion spaced uprights extending upward from the central portion of said rear cross members such that said reel support shaft extends forward from said base at the midpoint between said opposing side members.

11. The wire dispensing caddy of claim 10, further comprising a lateral angle brace extending between each of said upright members and the adjacent end of said rear cross member.

12. The wire dispensing caddy of claim 11, further comprising a forward brace extending between each said lateral angle brace and the adjacent base side member.

13. The wire dispensing caddy of claim 11, wherein the lower portion of each said frame upright is angled forward from vertical between said rear base member and the attachment points of said angle braces.

14. The wire dispensing caddy of claim 7, wherein each said reel hub extends axially from said circular plate between said "U"-shaped coil supports.

15. The wire dispensing caddy of claim 14, wherein said shaft cross-bores are spaced at ¼ inch intervals starting from the free end of said reel support shaft.

16. The wire dispensing caddy of claim 15, wherein each of said inner and said outer reel portions is identical in structure.

17. The wire dispensing caddy of claim 3, wherein said caddy is 23 inches in overall height, each said outer rim is 15 inches in diameter, and said caddy upright portion is 5¼ inches in width and said reel support shaft is about ¾ inch in diameter.

18. The wire dispensing caddy of claim 10, wherein said front and said rear cross members of said base are 18 inches in length and said opposing side members are 8 inches in length.

* * * * *